US005315858A

United States Patent [19]

Naggert et al.

[11] Patent Number: 5,315,858

[45] Date of Patent: May 31, 1994

[54] METHODS AND APPARATUS FOR REDRAWING THIN-WALLED CONTAINER BODIES

[75] Inventors: Dieter K. Naggert, Oak Forest; James J. Tang, Palatine; Robert J. Gruodis, Palos Hts., all of Ill.

[73] Assignee: Crown Cork & Seal Company, Inc., Philadelphia, Pa.

[21] Appl. No.: 979,279

[22] Filed: Nov. 20, 1992

[51] Int. Cl.[5] ..... B21D 22/22

[52] U.S. Cl. ..... 72/350; 72/347

[58] Field of Search ..... 72/347, 349, 350, 348

[56] References Cited

U.S. PATENT DOCUMENTS

| | | | |
|---|---|---|---|
| 3,664,172 | 5/1972 | Cvacho | 72/350 |
| 3,724,247 | 4/1973 | Page | 72/60 |
| 3,826,123 | 7/1974 | Hasselbeck | 72/349 |
| 4,361,020 | 11/1982 | Hirota et al. | 72/57 |
| 4,386,514 | 6/1983 | Herten | 72/350 |
| 4,425,778 | 1/1984 | Franck et al. | 72/347 |
| 4,485,663 | 12/1984 | Gold et al. | 72/347 |
| 4,685,322 | 8/1987 | Clowes | 72/348 |
| 4,833,903 | 5/1989 | de Smet | 72/350 |
| 4,962,659 | 10/1990 | Imazu et al. | 72/349 |
| 5,014,536 | 5/1991 | Saunders | 72/349 |
| 5,083,449 | 1/1992 | Kobayashi et al. | 72/349 |
| 5,119,657 | 6/1992 | Saunders | 72/42 |

FOREIGN PATENT DOCUMENTS

| | | | |
|---|---|---|---|
| 0804093 | 2/1981 | U.S.S.R. | 72/350 |
| 1484407 | 6/1989 | U.S.S.R. | 72/350 |

*Primary Examiner*—David Jones

*Attorney, Agent, or Firm*—Woodcock Washburn Kurtz Mackiewicz & Norris

[57] ABSTRACT

Methods and apparatus for redrawing a drawn cup are disclosed. In particular, the methods and apparatus disclosed are directed to redrawing a container body for use in a two piece beverage container. The redraw operation uses a redraw sleeve and a redraw ring that prevent wrinkles when a thin gauge metal is employed. The wrinkles are prevented by providing cooperating displacements on the surfaces of the redraw ring and the redraw sleeve that clamp the bottom surface of the cup that is being redrawn. This displacement provides a convoluted path through which the metal is pulled during the redraw operation to increase the resistance to being drawn and the tension in the side wall, thereby substantially eliminating wrinkles.

11 Claims, 1 Drawing Sheet

METHODS AND APPARATUS FOR REDRAWING THIN-WALLED CONTAINER BODIES

The present invention relates to methods and apparatus for forming deep drawn shells from light gauge metals, such as aluminum alloys. More particularly, the present invention relates to drawing the body portion of a two piece beverage container.

BACKGROUND OF THE INVENTION

The drawn and ironed two piece beverage container is a highly engineered article of manufacture. However, improvements are constantly being sought that will permit reliable containers to be made with less metal. Due to the extremely high volume in which such containers are manufactured, even the smallest savings in the metal from which they are made can result in enormous cost reductions. For example, it would be desirable to reduce the starting gauge of such containers by as little as one one-tenthousandth (0.0001) of an inch.

One of the fundamental operations required to form a two piece beverage container is the drawing, redrawing and wall ironing of a thin sheet of metal into a deep cup that essentially forms the body of the container, i.e., the portion that holds the liquid. Although the bulk of the drawn and ironed containers presently manufactured are formed of aluminum or aluminum alloys, other metals, such as steel are also drawn and redrawn using substantially the same techniques.

U.S. Pat. No. 4,425,778—Franek et al. discloses methods and apparatus for redrawing a can body by pulling the side wall through an S-shaped path by bending the side wall of the cup that is being redrawn around a redraw ring to induce tensions to stretch the metal and reduce the wall thickness that can be redrawn without wrinkles.

U.S. Pat. No. 4,685,322—Clowes discloses a redrawing die that has an inwardly projecting annular bead formed on the redraw ring to prevent wrinkling in the end wall of a container as it is redrawn.

U.S. Pat. No. 4,962,659—Inazu et al. discloses apparatus for redrawing a drawn cup by relatively moving a redrawing die in a redrawing punch wherein the redrawing die and punch comprise portions that engage one another to clamp the cup and permit a redrawn cup of a relatively thin wall to be reformed.

U.S. Pat. No. 5,083,449—Kobayashi et al. discloses apparatus for redrawing a flanged cup using a redraw ring that has a working face having an inner diameter which is gradually decreased and a peripheral portion that clamps the flanged cup to the redraw ring.

However, it has been found that using the methods and apparatus of the prior art, as the gauge of the metal is reduced, wrinkling occurs in the unsupported nose portion of the container as the cup is redrawn. For this reason, a wrinkle-free redrawn cup cannot be produced when the thickness of the base metal is below 0.0113 inches using the technology currently available. Radial faults develop in the area of the cup face that is not directly clamped nor in contact with the punch. This phenomenon is thought to be due to insufficient holding force being developed between the bottom of the cup, the face of the redraw ring, and the corresponding face of any clamping means associated with it. It would be desirable to provide methods and apparatus whereby thinner gauge metals could be redrawn to produce lightweight container bodies. Therefore, it is an object of the present invention to provide methods and apparatus for increasing the clamping force during a redraw operation such that the wrinkling of the unsupported nose portion is eliminated.

SUMMARY OF THE INVENTION

The present invention achieves these and other objectives by providing apparatus for forming a container body comprising a redraw sleeve comprising an outer cylindrical surface connected to an end surface by a transition surface that is displaced from the end surface and a redraw ring comprising an inner surface connected to a clamping surface that is displaced from a lateral surface. Preferably, the transition surface and the clamping surface are in substantial registration when the redraw sleeve is urged against the redraw ring. In certain embodiments the transition surface is displaced above the end surface and the clamping surface is displaced below the lateral surface. In other embodiments, the transition surface is displaced below the end surface and the clamping surface is displaced above the lateral surface. In accordance with preferred embodiments of the present invention, the redraw sleeve and redraw ring each comprise an outer peripheral portion, and the transition surface and clamping surface are each respectively disposed in one of the peripheral portions.

The present invention also provides methods of redrawing a drawn cup comprising the steps of inserting a drawn cup between a redraw sleeve and a redraw ring, and drawing the cup into a redrawn container. In accordance with the present invention, a portion of the cup is drawn through a transition surface formed on the redraw sleeve and in substantial registration with a clamping surface formed on the redraw ring.

DETAILED DESCRIPTION OF THE PREFERRED EMBODIMENTS

Figure 1:
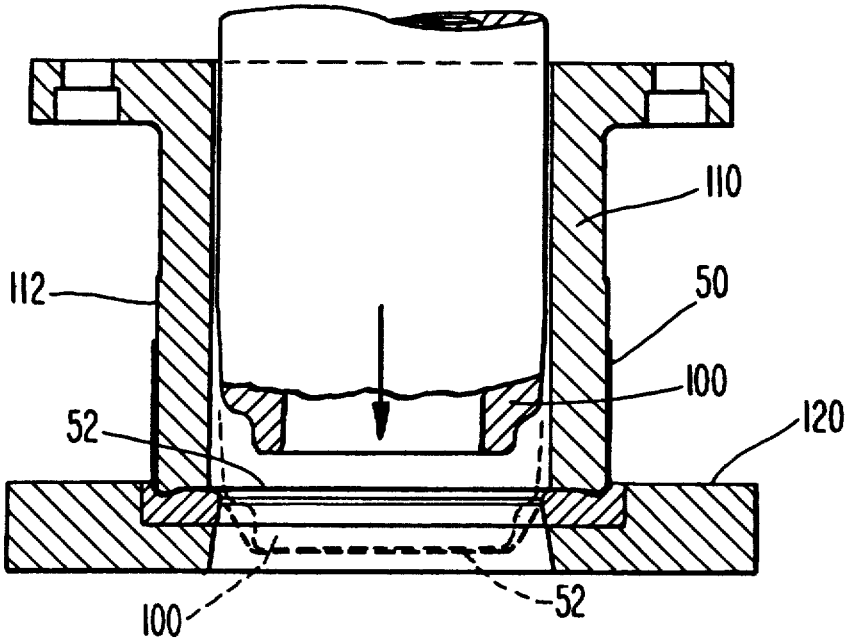
FIG. 1 is an elevation view, partially in cross-section of a redraw ring and a redraw sleeve made in accordance with the present invention.

Referring now to FIG. 1, there is shown a redraw sleeve 110 and a redraw ring 120 made in accordance with the present invention. As illustrated, the redraw sleeve 110 and the redraw ring 120 are shown engaged with a drawn cup 50 about to be redrawn using a wall ironing punch 100. As seen in FIG. 1, the punch 100 is preferably substantially in the shape of the bottom profile of the finished container. As shown in phantom, as the punch 100 moves in the direction shown by the arrow the cup 50 is first stretched as shown and then is redrawn between the redraw sleeve 110 and the redraw ring 120. During operation, as will be readily understood by those of ordinary skill, the redraw punch 100 will be urged against the end wall 52 of the cup 50 and will pull material between the redraw sleeve 110 and the redraw ring 120. However, as explained in further detail below, the present invention provides displaced portions on the redraw sleeve 110 and redraw ring 120 that increase the resistance to the redrawing operation and thereby increase the tension in the material 180 within the unsupported nose portion of the container, resulting in a substantially wrinkle free container.

Figure 2:
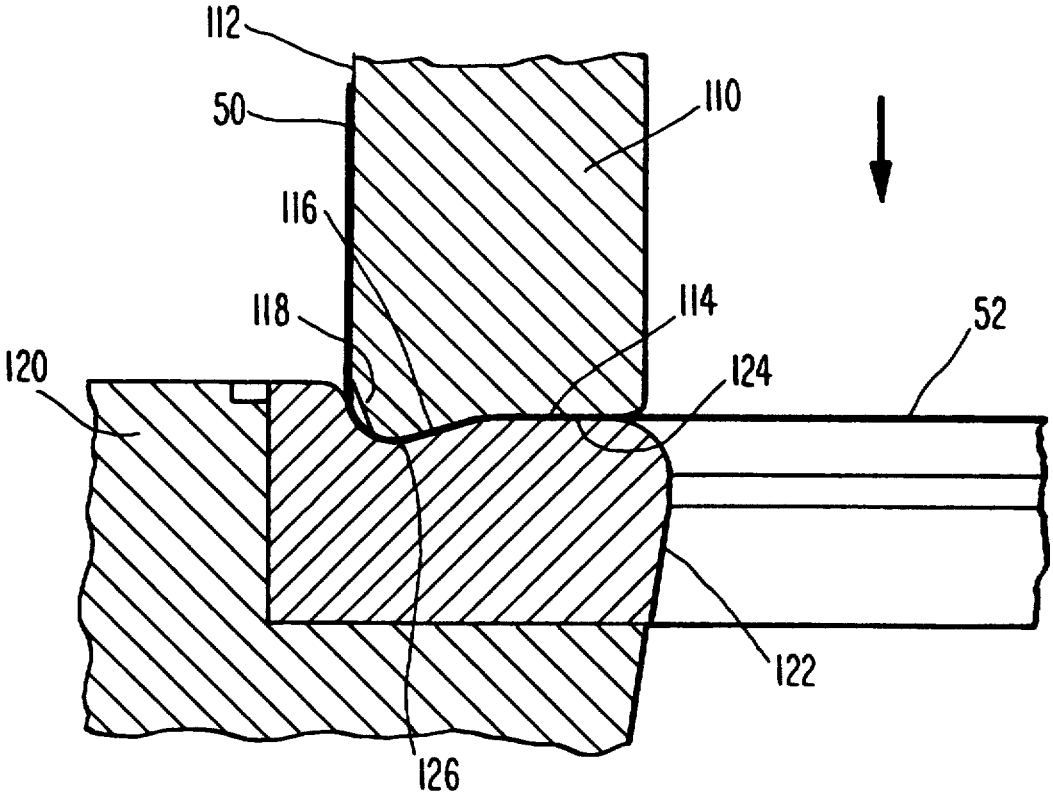
FIG. 2 is a broken away, greatly enlarged view of a portion of the apparatus depicted in FIG. 1.

Referring now to FIG. 2, there is shown an enlarged fragmentary view of the apparatus illustrated in FIG. 1.

In FIG. 2, it can be seen that the redraw sleeve 110 includes an outer cylindrical surface 112 connected to an end surface 114 by a transition surface 116. The end surface 114 defines a plane, and the circumferential transition surface 116 is displaced from the plane of the end surface 114. As shown in FIG. 2, this displacement is preferably positive, i.e., the transition surface 116 is displaced outwardly from the end surface 114 relative to the direction of the redrawing operation. Alternatively, the transition surface 116 may be the reverse of that illustrated in FIG. 2 and be in the form of a depression or a portion recessed inwardly relative to the direction of the redraw operation. Additionally, the transition surface 116 may be located at portions other than the outer peripheral portion of the redraw sleeve 110. A taper surface 118 is preferably located between the transition surface 116 and the outer cylindrical surface 112. The taper surface 118 provides a relief area and concentrates the clamping force directly to the transition surface 116 in a location that is substantially perpendicular to the direction of the redrawing and wall ironing operation.

FIG. 2 also illustrates further details of the redraw ring 120. The redraw ring 120 comprises an inner surface 122 that is connected to a clamping plane 124 that comprises a clamping surface 126 displaced from the clamping plane 124. In the preferred embodiment illustrated, the clamping surface 126 is in the form a recess, i.e., it is positively displaced relative to the direction of the redraw operation. However, in alternate embodiments of the redraw sleeve referred to above, the clamping surface 126 would be altered in order to substantially register with the contour of the displacement from the redraw sleeve 110. In other words, if the transition surface 116 were reversed and displaced inwardly, the clamping surface 126 would also be reversed and protrude above the clamping plane 124.

In operation, a drawn cup is redrawn by inserting a drawn cup between a redraw sleeve and a redraw ring, and drawing the cup into a redrawn container. In accordance with the present invention, a portion of the cup is drawn through a transition surface formed on the redraw sleeve and in substantial registration with a clamping surface formed on the redraw ring.

The methods and apparatus disclosed herein can be used to redraw thin walled containers from drawn cups, such as the cup 50 shown in FIG. 1. In one preferred embodiment, such cups 50 have walls of a thickness less than about 0.0113 inches and thereby provide a decrease in the weight of the resulting container as compared to current designs.

Although certain embodiments of the present invention have been disclosed and discussed above with particularity, these examples are meant to be illustrative of the present invention and are not meant to be limiting. Upon review of this specification, those of ordinary skill in the art will realize that numerous modifications, adaptations and variations may be made to the concepts disclosed herein to realize alternate and useful embodiments of the present invention. Accordingly, reference should be made to the appended claims in order to determine the true scope of the present invention.

What is claimed:

1. Apparatus for forming a cylindrical, aluminum container body in the shape of a cup with a bottom that has an inside surface by a direct redraw operation, the apparatus comprising:

a direct redraw sleeve comprising an outer cylindrical surface connected to an end surface by a transition surface, wherein the transition surface is displaced from the end surface to define a convoluted surface; and a direct redraw ring comprising an inner surface connected to a convoluted clamping surface wherein the clamping surface is displaced from a lateral surface wherein the convoluted surface of the end surface and the convoluted clamping surface are substantially parallel and define a convoluted path of a fixed width.

2. The apparatus of claim 1, wherein the transition surface is displaced above the end surface and the clamping surface is displaced below the lateral surface.

3. The apparatus of claim 1, wherein the transition surface is displaced below the end surface and the clamping surface is displaced above the lateral surface.

4. The apparatus of claim 1, wherein the redraw sleeve and redraw ring each comprise an outer peripheral portion and the transition surface and clamping surface are each respectively disposed in one of the peripheral portions.

5. The apparatus of claim 1 further comprising a taper surface disposed between the outer cylindrical surface and the transition surface of the redraw sleeve.

6. Apparatus for the direct redrawing of a drawn cup in a redraw press having a drawing direction comprising:

a direct redraw sleeve defining a transition surface, comprising a displaced sleeve portion; and a direct redraw ring defining a clamping surface, comprising a displaced ring portion, whereby the displaced sleeve and ring portions are parallel and in substantial registration and cooperate to create a convoluted redrawing path of a fixed width during a redrawing operation.

7. The apparatus of claim 5, wherein the transition surface and the clamping surface are substantially perpendicular to the redrawing direction.

8. The apparatus of claim 5, wherein the redraw sleeve comprises an outer cylindrical surface and a taper surface disposed between the outer cylindrical surface and the transition surface.

9. A method for the direct redrawing a drawn cup having a wall thickness comprising the steps of:

inserting the drawn cup between a direct redraw sleeve and a direct redraw ring; and drawing the cup into a redrawn container, wherein a portion of the cup is drawn through a convoluted transition surface formed on the direct redraw sleeve parallel to and in substantial registration with a convoluted clamping surface formed on the direct redraw ring to create a convoluted redrawing path of a fixed width equal to the wall thickness, whereby the direct redrawing of the cup through the convoluted redrawing path does not reduce the wall thickness.

10. A thin walled container body formed by the method of claim 9.

11. The thin walled container of claim 10 wherein the wall of the container is redrawn and wall ironed from cup having a thickness of less than 0.0113 inches.

* * * * *

UNITED STATES PATENT AND TRADEMARK OFFICE

CERTIFICATE OF CORRECTION

PATENT NO. : 5,315,858

DATED : May 31, 1994

INVENTOR(S) : Dieter K. Naggert; James J. Tang; Robert J. Gruodis

It is certified that error appears in the above-indentified patent and that said Letters Patent is hereby corrected as shown below:

Col. 4, line 11, after "surface" insert --, and--.

Signed and Sealed this

Fifth Day of December, 1995

*Attest:*

Bruce Lehman

BRUCE LEHMAN

*Attesting Officer*

*Commissioner of Patents and Trademarks*